US007310881B2

(12) United States Patent
Ohuka

(10) Patent No.: US 7,310,881 B2
(45) Date of Patent: Dec. 25, 2007

(54) PENCIL SHAVING DEVICE

(76) Inventor: Caleb Karepa Ohuka, 4 Altair Court, Gladstone Park, Victoria 3043 (AU)

( * ) Notice: Subject to any disclaimer, the term of this patent is extended or adjusted under 35 U.S.C. 154(b) by 0 days.

(21) Appl. No.: 10/545,223

(22) PCT Filed: Feb. 10, 2004

(86) PCT No.: PCT/AU2004/000146

§ 371 (c)(1),
(2), (4) Date: Aug. 10, 2005

(87) PCT Pub. No.: WO2004/069558

PCT Pub. Date: Aug. 19, 2004

(65) Prior Publication Data

US 2006/0053641 A1 Mar. 16, 2006

(30) Foreign Application Priority Data

Feb. 10, 2003 (AU) ..... 2003904280

(51) Int. Cl.
*B43L 23/06* (2006.01)

(52) U.S. Cl. ..... 30/456; 30/461

(58) Field of Classification Search ..... 30/457, 30/462, 456, 451, 278, 280, 281, 286, 289, 30/294, 461
See application file for complete search history.

(56) References Cited

U.S. PATENT DOCUMENTS

| | | | | | |
|---|---|---|---|---|---|
| 716,732 | A | * | 12/1902 | Mead | 30/461 |
| 888,669 | A | * | 5/1908 | John | 30/456 |
| 1,531,738 | A | * | 3/1925 | Davis | 30/452 |
| 1,844,729 | A | * | 2/1932 | Wells | 15/105.53 |
| 3,851,687 | A | * | 12/1974 | Jones | 30/451 |
| D254,858 | S | * | 4/1980 | Mobius | D19/73 |
| 5,020,408 | A | * | 6/1991 | Idema | 83/446 |
| 5,167,071 | A | * | 12/1992 | Eisen | 30/452 |

FOREIGN PATENT DOCUMENTS

| | | | |
|---|---|---|---|
| DE | 298 05 229 U1 | * | 7/1998 |
| EP | 0021493 A1 | * | 6/1980 |
| FR | 2 679 492 | * | 1/1993 |

* cited by examiner

*Primary Examiner*—Hwei-Siu C. Payer
(74) *Attorney, Agent, or Firm*—Edwin D. Schindler

(57) ABSTRACT

An article for shaving pencils having a body member with a bore in the body member for receiving a pencil. The bore has at least one aperture or opening. The body member further includes a cutting, or shaving, device, so that upon a manual insertion of a pencil into the bore, and subsequent withdrawal of the pencil from the bore, a portion of the pencil is shaved off by the cutting, or shaving, device for providing a suitable surface for labelling of the pencil.

16 Claims, 3 Drawing Sheets

PENCIL SHAVING DEVICE

TECHNICAL AREA

The invention relates to the area of pencil shaving devices and in particular, to a pencil shaving device providing a means of shaving pencils for the purposes of labelling.

BACKGROUND OF THE INVENTION

The concept of labelling pencils for school children for use at pre-school, primary school or secondary school is one which has been around for decades. Conventionally, labels were made using sticky tape or stickers however, this proved to be quite unsatisfactory as the labels would often fall off and then the pencils would be lost or taken by others.

Attempts to solve this problem have involved holding the pencil, cutting or shaving off a portion of the non-writing end of the pencil with an open razor blade or knife, and then scribing a name on the cut or shaved portion of the pencil. This method is not only time consuming due to the care which must be taken when using a blade or knife, but extremely dangerous to the user.

In addition, previous attempts have failed to produce satisfactory results, often resulting in an uneven cut or shaved portions, or else having a cut or shaved portion that is too large whereby, the internal graphite is exposed to the surface of the pencil.

OUTLINE OF THE INVENTION

It is an object of the present invention to overcome or substantially ameliorate the problems of the prior art by providing a pencil sharpening device that is adapted to provide a cut or shaved portion on a pencil surface for labelling of the pencil.

The invention provides, a device for pencil shaving having a body member, a bore which is adapted to receive a pencil, at least one aperture or opening, and a cutting means whereby, when there is a manual insertion of a pencil into the said bore and subsequent withdrawal of the pencil from the said bore, a portion of the pencil is shaved off by the said cutting means.

It is preferred that the bore be a hollowed cavity created within the body member which may be tapered at one end.

It is preferred that the bore be provided with at least one aperture or opening.

It is further preferred that a back end of the bore can have a width that is greater or less than the diameter of a pencil to determine how far the pencil is able to pass through the bore of the body member.

It is preferred that the cutting means be provided with a blade that is positioned at an angle suitable to cut or shave the surface of the pencil as it is withdrawn from the pencil shaving device It is also preferred that the body member be provided with ramps made of a resilient material or other suitable material, or other means adapted to guide the pencil and ensure a clean cut is achieved.

In order that the invention be more readily understood we will describe by way of non-limiting examples specific embodiments of the device made in accordance with the invention.

BRIEF DESCRIPTION OF THE DRAWING FIGURES

DESCRIPTION OF AN EMBODIMENT OF THE INVENTION

Figure 1:
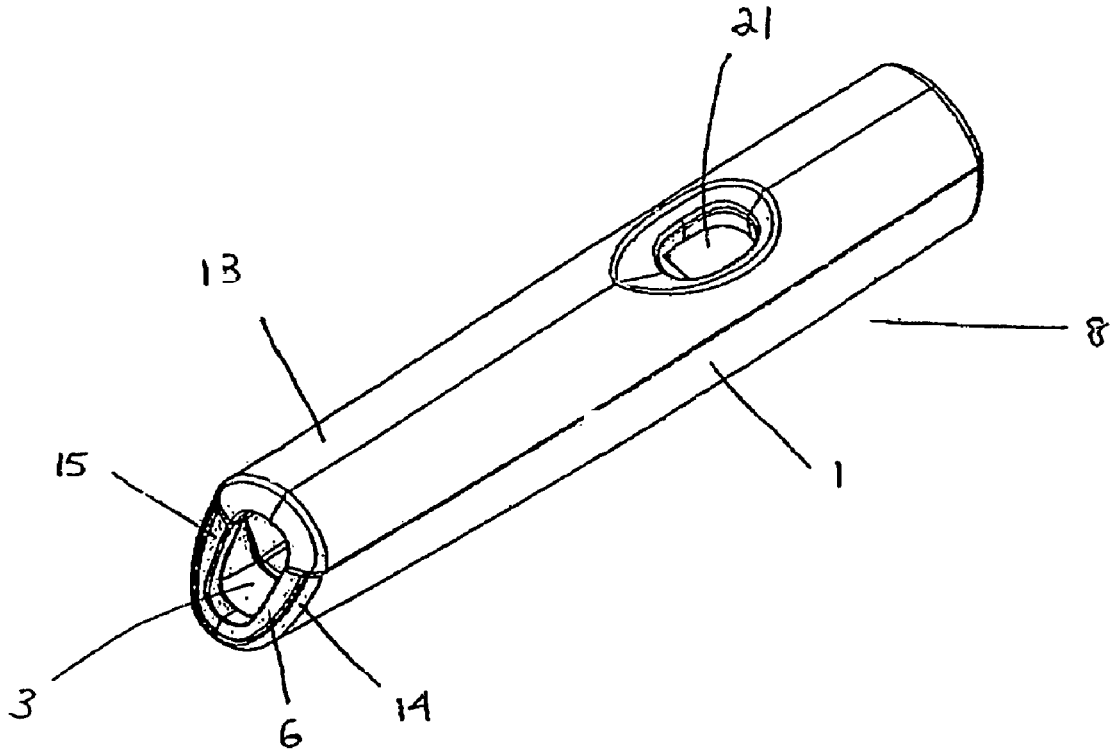
FIG. 1 is a side perspective view of the pencil shaving device according to a preferred embodiment of the invention.
Figure 2:
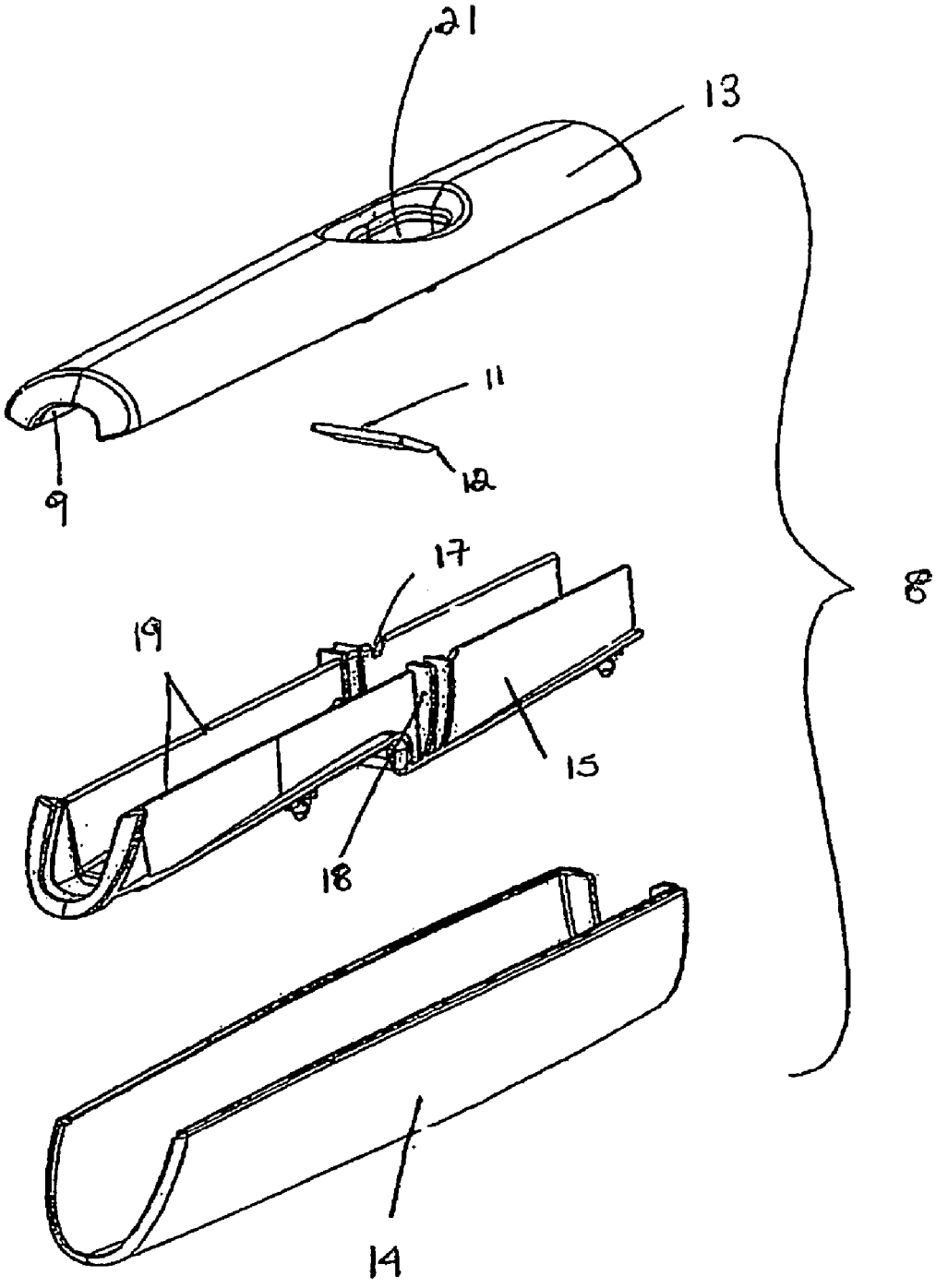
FIG. 2 is an exploded view of the pencil shaving device.
Figure 3:
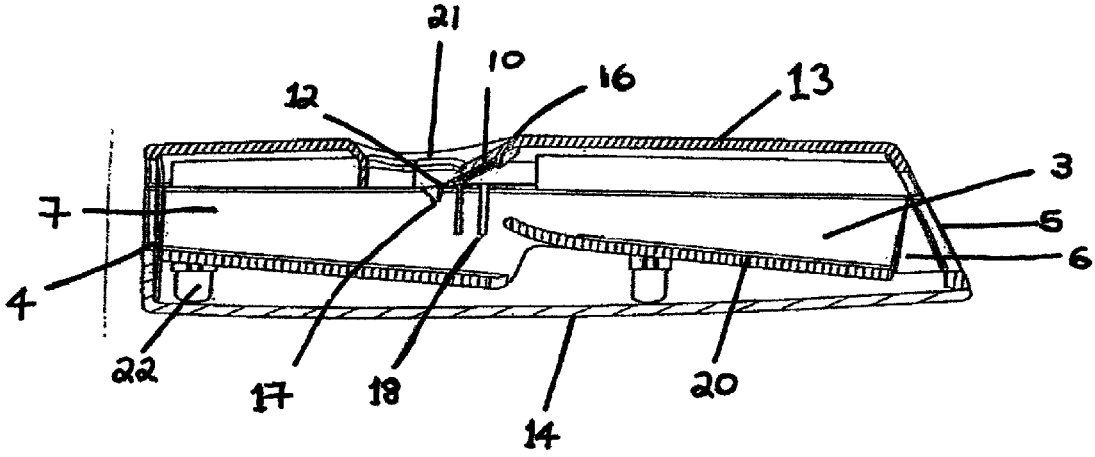
FIG. 3 is a side sectional view of the pencil shaving device according to a preferred embodiment of the invention.

FIGS. 1 to 3 show a preferred embodiment of the invention as it relates to a pencil shaving device.

In this embodiment of the invention, the pencil shaving device 8 has a body member 1 having an upper 13, lower 14 and intermediate portion 15 of a suitable construction, and can be made from any resilient material such as wood, fibreglass, plastic or the like. The body member 1 can have any suitable width or diameter such that, the device according to the invention can be comfortably handled or gripped by a human hand of any size, including children. The body member 1 can also be of any suitable length such that is adapted to receive pencil shafts of varying lengths.

The body member 1 is provided with a bore 3. The bore 3 is a hollowed cavity entry end 5 of the bore, has an internal width which is greater than the diameter of the pencil to be shaved or cut. The front entry end 5 is provided with a first aperture or opening 6 which is adapted to provide a means for receiving the shaft of the pencil into the body member.

It is envisaged that the back end 4 of the bore may have provided a second aperture or opening 7 such that, a pencil shaft to be shaved or cut can be inserted through the entire body member 1. In this way, the pencil shaving device is not only able to accommodate pencils of various lengths, but also provide a means whereby the pencil is able to be labelled anywhere along the shaft as desired by the user.

The bore 3 is formed such that, the back end 4 has a square cross-sectional construction or shape, and the front entry end 5 has a rectangular cross-sectional construction or shape. In a preferred embodiment of the invention, the corners of the bore 3 are formed so that, they are rounded.

The bore 3 may be provided with at least one extension 18 along its side to give rigidity to the construction of the pencil shaving device.

Provided along the base of the intermediate portion 15 and thus, base of the bore 3, are two (2) ramps 20 which further assist in guiding the pencil through the pencil shaving device 8. It is envisaged that these ramps 20, and ramp supports 22, are made of a resilient material or other suitable material, which is able to be depressed as the pencil shaft passes through the device 8, whilst also providing sufficient and even support and force as the pencil is being withdrawn to ensure that the surface of the pencil shaft remains in close contact with the blade edge 12 to produce a clean cut.

In a first embodiment of the invention, the back end 4 of the bore 3 may have an internal width that is greater than the diameter of any pencil shaft to be received by the body member 1 such that, when the pencil shaft is manually inserted through the first aperture or opening 6, the pencil shaft can be allowed to slide through the bore 3 and the entire body member 1 and out through the second aperture or opening 7, enabling the user to have a personal choice in the length of the pencil to be shaved or cut by the pencil shaving device 8. When the pencil shaft is at this position, the bore 3 of the body member 1 can then stabilize the pencil and provide a means for allowing the inserted pencil shaft to be pivoted within the bore 3 by the user.

In a second embodiment of the invention, the back end 4 of the bore 3 may have an internal width which is less than the diameter of any pencil shaft to be received by the body member 1 such that, when the pencil shaft is manually inserted through the first aperture or opening 6, the pencil shaft will eventually reach a position somewhere along the back end 4 of the bore 3 where the diameter of the back end 4 is such that, the pencil shaft must be prevented from entering further into the body member 1. When the pencil shaft is at this position, the bore 3 of the body member 1 can then stabilize the pencil and provide a means for the allowing the inserted pencil shaft to be pivoted within the bore 3 by the user.

Positioned toward the back end 4 of the bore 3, is a cutting means 10. The cutting means is provided with a blade 11 which may be made from any material such as stainless steel. The blade is located between an upper notch 16 provided on the internal wall 9 of the upper portion 13 and a lower notch 17 provided on the upper edge 19 of the intermediate portion 15 of the body member 1. The edge of the blade 11 may be positioned at an angle to the longitudinal direction of the bore 3 pointing in a downward direction toward the back end 4.

The upper portion 13 of the body member 1 is provided with a third aperture or opening 21. The third aperture or opening 21 is recessed such that, as the pencil is withdrawn and a cut portion is being formed, the newly creating shaving is led to slide upwardly and out from the third aperture or opening 21.

The pencil shaving device 8 according to the invention, is adapted to receive a pencil that is commercially available and is preferably made from wood or any other material that is capable of being cut by such a blade 11.

In practice, a pencil shaft is manually inserted through the first aperture or opening 6 of the bore 3 of the body member 1, which is positioned at the front entry end 5 of the bore 3. It should be noted that throughout the specification, the shaft refers to the non-writing end of the pencil whose end is generally flush in construction and does not have any exposed graphite.

Once the pencil shaft has been inserted through the bore 3 of the body member 1, whether it be through the entire bore 3 or most of the bore 3 depending on the type of pencil shaving device 8 being used, the pencil shaft is then manually pivoted within the bore 3 by the user, through an angle of less than ninety (90) degrees, to a position where the pencil shaft is able to make contact or abut the blade 11 positioned inside the bore 3.

Whilst the pencil shaft is in contact with or abutting the blade 11, it is manually withdrawn by the user from the body member 1 back out through the first aperture or opening 6 of the bore 3. The action of moving the contacted or abutted pencil shaft across the blade edge 12 as it is being withdrawn from the body member 1 results in a cutting, shearing or shaving of a portion of the material of the pencil shaft. The result is a cut or shaved region having flat surface which is suitable for writing, marking or labelling by the user.

Marking of the cut pencil may be achieved by writing, marking or labelling of the cut region of the pencil by any suitable means including a biro pen, pencil, texta or adhesive label.

Whilst we have described herein specific embodiments of the invention, it is to be understood that other embodiments of the invention will exhibit any number of and any combination of the features previously described, and any and all such variations and modifications can be made in the invention without departing from the spirit and scope of the invention.

The claims defining the invention are as follows:

1. An article for shaving pencils, comprising:

a body member having a tapered bore for receiving a pencil, the tapered bore having a first aperture at a front end of the tapered bore with a second aperture being at a rear end of the tapered bore for enabling a user of said article to choose a length of the pencil to be shaved, the rear end of the tapered bore being an end opposite the front end of the bore;

means for shaving the pencil upon a manual insertion of the pencil into the tapered bore of said body member, so that upon a subsequent withdrawal of the pencil from the tapered bore, a portion of the pencil is shaved off by said means for shaving; and, at least one ramp made of a resilient material located along a base of the tapered bore of said body member for guiding the pencil through said body member, said at least one ramp providing a sufficient and even biasing force against the pencil in one direction for ensuring that the pencil remains in contact with said means for shaving.

2. The article for shaving pencils according to claim 1, wherein the tapered bore of said body member is a hollowed cavity created within said body member.

3. The article for shaving pencils according to claim 1, wherein the tapered bore of said body member includes a third aperture or opening located on an upper portion of said body member.

4. The article for shaving pencils according to claim 1, wherein a rear end of the tapered bore of said body member has an internal width greater than a diameter of the pencil, so that the pencil is passable through the entirety of the tapered bore of said body member.

5. The article for shaving pencils according to claim 1, wherein a rear end of the tapered bore of said body member has an internal width less than a diameter of the pencil, so that the pencil is passable through only a portion of the tapered bore of said body member.

6. The article for shaving pencils according to claim 1, wherein said means for shaving is positioned on an internal wall of the tapered bore of said body member.

7. The article for shaving pencils according to claim 6, wherein said means for having includes a blade.

8. The article for shaving pencils according to claim 7, wherein said blade is angled for shaving off a portion of the pencil as the pencil is withdrawn from said article.

9. The article for shaving pencils according to claim 1, further comprising extensions positioned on either side of said body member for providing rigidity to the article.

10. The article for shaving pencils according to claim 1, wherein said at least one ramp made of a resilient material is two ramps of said resilient material located along said base of the tapered bore of said body member.

11. An article for shaving pencils, comprising:

a body member having a tapered bore for receiving a pencil, wherein a rear end of the tapered bore of said body member has an internal width greater than a diameter of the pencil, so that the pencil is passable through the entirety of the tapered bore of said body member;

means for shaving the pencil upon a manual insertion of the pencil into the tapered bore of said body member, so that upon a subsequent withdrawal of the pencil from the tapered bore, a portion of the pencil is shaved off by said means for shaving; and, at least one ramp made of a resilient material located along a base of the tapered bore of said body member for guiding the pencil through said body member, said at least one ramp providing a sufficient and even biasing force against the pencil in one direction for ensuring that the pencil remains in contact with said means for shaving.

12. The article for shaving pencils according to claim 11, wherein the tapered bore of said body member includes an aperture or opening located on an upper portion of said body member.

13. The article for shaving pencils according to claim 11, wherein said means for shaving the pencil includes a blade that is angled for shaving off a portion of the pencil as the pencil is withdrawn from said article.

14. An article for shaving pencils, comprising:

a body member having a tapered bore for receiving a pencil, wherein a rear end of the tapered bore of said body member has an internal width less than a diameter of the pencil, so that the pencil is passable through only a portion of the tapered bore of said body member;

means for shaving the pencil upon a manual insertion of the pencil into the tapered bore of said body member, so that upon a subsequent withdrawal of the pencil from the tapered bore, a portion of the pencil is shaved off by said means for shaving; and, at least one ramp made of a resilient material located along a base of the tapered bore of said body member for guiding the pencil through said body member, said at least one ramp providing a sufficient and even biasing force against the pencil in one direction for ensuring that the pencil remains in contact with said means for shaving.

15. The article for shaving pencils according to claim 14, wherein the tapered bore of said body member includes an aperture or opening located on an upper portion of said body member.

16. The article for shaving pencils according to claim 14, wherein said means for shaving the pencil includes a blade that is angled for shaving off a portion of the pencil as the pencil is withdrawn from said article.

* * * * *